United States Patent [19]

Ore et al.

[11] 4,133,853

[45] Jan. 9, 1979

[54] AEROSOL CARBONATOR

[75] Inventors: William C. Ore, Elmhurst; Sigmund P. Skoli, Elmwood Park, both of Ill.

[73] Assignee: Mojonnier Bros. Co., Chicago, Ill.

[21] Appl. No.: 827,897

[22] Filed: Aug. 26, 1977

[51] Int. Cl.[2] ..... B01F 3/04

[52] U.S. Cl. ..... 261/140 R; 261/DIG. 7; 141/82; 222/318

[58] Field of Search ..... 141/3, 20, 94, 95, 82, 141/9, 100, 101, 102, 103, 104, 105; 261/DIG. 7; 99/275; 426/36 S; 55/39, 46; 222/1, 318; 137/11 S; 62/306, 307; 165/154

[56] References Cited

U.S. PATENT DOCUMENTS

| | | | |
|---|---|---|---|
| 3,741,552 | 6/1973 | Skoli et al. | 261/DIG. 7 |
| 3,877,358 | 4/1975 | Karr | 261/DIG. 7 |
| 4,028,441 | 6/1977 | Richards | 261/DIG. 7 |
| 4,068,010 | 1/1978 | Karr | 261/DIG. 7 |

*Primary Examiner*—Houston S. Bell, Jr.
*Attorney, Agent, or Firm*—Olson, Trexler, Wolters, Bushnell & Fosse, Ltd.

[57] ABSTRACT

An aerosol carbonator is provided for charging a fluid, such as an alcohol-based fluid, with a carbon dioxide propellant for later placement in aerosol-style valved cans. The aerosol carbonator comprises a vertically elongated vessel having inlet means at the vessel top, an evaporative cooler in the vessel mediate portion, and a sump and fluid outlet means at the vessel bottom. Recirculating means are provided for returning to the carbonator vessel fluid amounts in excess of those fluid amounts required to be fed into down-stream filler devices to satisfy the source of variable fluid demand in the devices.

20 Claims, 1 Drawing Figure

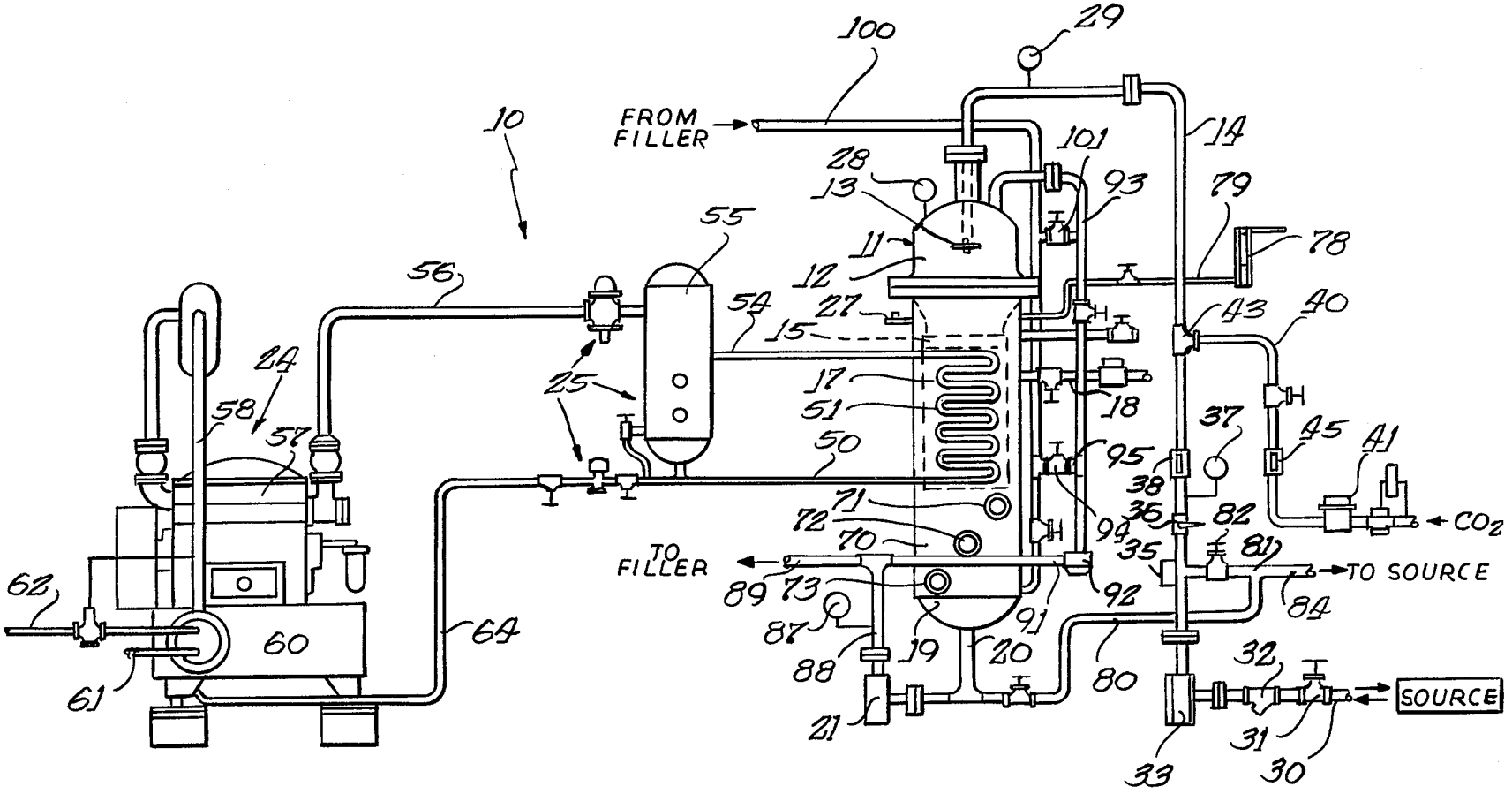
SOURCE
TO SOURCE
$CO_2$
FROM FILLER
TO FILLER

AEROSOL CARBONATOR

BACKGROUND OF THE INVENTION

This invention relates generally to aerosol carbonators, and more particularly concerns apparatus for charging a fluid, such as an alcohol-based fluid, with an aerosol propellant, such as carbon dioxide.

Aerosol containers for dispensing fluid such as perfumes, cleaners, and other products have become so important in today's economy as to be almost omnipresent. At present, a majority of these products include a valved can in which is contained the product and a chlorofluorocarbon propellant.

Recent evidence indicates that these chlorofluorocarbon propellants, when discharged into the atmosphere by using the aerosol spray cans, may alter the amount of ozone present in the earth's atmosphere and, consequently, may cause environmentally unacceptable effects. In this regard, the U.S. Federal Government and foreign nations have begun to pose regulations and laws to restrict the use of chlorofluorocarbons as aerosol propellants in the future. The aerosol industry has, therefore, begun a search for alternate propelling agents.

One such agent which shows promising characteristics is carbon dioxide. Apparatus for charging fluids such as alcohol-based fluids with a carbon dioxide propellant, and for emplacing this fluid and charges of gas within containers has recently meet with great commercial interest.

In high-volume production of charged cans, it is important to provide the charged product at a given pressure and in quantities sufficient to supply rapidly operating can filler devices. It is also important that the apparatus which charges the fluid with the propellant be able to quickly accommodate temporary halts in container filler line operation, resumption of filler operations, or charges in filling line speeds. These accommodations are not easy to make, for the container filling apparatus normally operates at high speed, and requires great quantities of product for the filling operation. Should filling operations suddenly stop, however, the fluid-propellant-charging apparatus must very rapidly switch from high output to no output without overburdening the now-stopped filler apparatus.

U.S. Pat. No. 3,232,324 to Sokol describes several elements of an apparatus for filling aerosol dispensers, but the apparatus is large, complex, expensive, and does not lend itself to high-speed but variable-rate operations.

It is accordingly the general object of the present invention to provide an aerosol carbonator system which can accommodate the widely varying liquid flow demands of a modern, high-speed container filler device operation.

Another object is to provide such apparatus in a relatively compact form so as to permit its installation in packaging plants of even restricted operating space.

Other objects and advantages of the invention will become apparent upon reading the following detailed description and upon reference to the accompanying drawing. Throughout this drawing, like reference numerals refer to like parts.

BRIEF DESCRIPTION OF THE DRAWING

The FIGURE is an illustration, in somewhat schematic form, of an embodiment of the invention including an aerosol carbonator saturator vessel and related piping and apparatus.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Turning more specifically to the drawing, there is shown a compact aerosol carbonator apparatus 10 which can provide large but quickly variable amounts of propellant-saturated or charged fluid to a filler device (not shown). In general, this apparatus includes a vertically elongated saturator vessel 11 having, at its top 12, inlet nozzles 13 which receive fluids such as alcohol-based fluids from a source (not shown), The nozzles 13 are connected to an inlet line 14. The fluid discharge through the nozzles 13 flows downwardly over a trough 15, where the fluid flow is arranged to provide an even flow over one or more cooling members or refrigerated coils 17. Here the fluid is cooled and placed in pressurized adsorptive contact with carbon dioxide gas introduced through an inlet 18. Carbon dioxide adsorption and charging occurs within the vessel 11 as the liquid is cooled by the evaporator coil elements 17 when gas is injected from the gas inlet pipe 18. Fluid falls into the bottom 19 of the vessel, through an outlet 20, and is pumped by a pump 21 to the filler apparatus (not shown). Refrigerant and an appropriate refrigeration effect is supplied by the refrigeration apparatus 24 and the refrigeration controls 25. An over-pressure relief valve 27 prevents excessively high pressure build-up within the vessel 11. Normally the tank can be maintained at a pressure of, for example, 150 PSIG, as displayed upon a gauge 28. The pressure in the inlet line 14 can be, for example, on the order of 250 PSIG as displayed upon an inlet line pressure gauge 29.

More specifically now, fluid is drawn from a source (not shown) through a preliminary inlet line 30 having a shut-off valve 31 and a strainer 32, and is pumped by a pump 33 into the inlet line 14. A back pressure regulator valve 35 insures that a constant fluid pressure such as 200 PSIG is experienced in the main inlet line 14. This pressure can be registered on a pressure gauge 37, and the rate of flow can be displayed upon a feed flow indicator 38.

To insure uniform, complete carbonation, carbon dioxide is preliminarily injected into the inlet feed line 14 through a carbon dioxide feed line 40. A gas flow regulator mechanism 41 assures that a constantly proportionally correct flow of gas is delivered to a Tee-type connection 43 for injection into the liquid feed flow inlet line 14. A gas flow control meter 45 can be provided to display information regarding this gas flow rate. This preliminary injection permits an economically low internal pressure to be provided in the saturator vessel, yet an output product of uniformly high quality can be obtained.

As explained above, the liquid is both pressurized, by the inflow pump 33, and is cooled by the element 17 to enhance its carbon dioxide-adsorping qualities. To this end, the evaporative cooler plate members 17 are provided with a low-pressure liquid refrigerant from a refrigerant input line 50. Low-pressure liquid refrigerant carried in the line 50 is introduced into evaporative coils 51 of the cooling unit 17; as the refrigerant changes state from a liquid to a gaseous form, heat is absorbed from the interior of the vessel 11 and the liquid flowing over the refrigerant coils. The low-pressure refrigerant gas is drawn away by a refrigerant evaporator exhaust line 54, through a surge control tank 55, and a compressor input line 56 to a compressor 57. Here the pressure of the refrigerant gas is raised and high-pressure refrigerant gas is discharged from the compressor through a compressor discharge line 58. This refrigerant gas enters a condenser 60 where the gas is cooled by cooling liquids such as water introduced to the condenser 60 through an inlet line 61. High-temperature condenser water is discharged through a condenser water discharge line 62. A cooled, now re-liquified refrigerant is drawn from the condenser 60 by a condenser discharge line 64 for routing through the controls 25 and the refrigerant surge tank 55.

If desired, the compactness and flexibility of the apparatus can be enhanced, in accordance with one aspect of the invention, by locating the refrigeration equipment 57, 60 in a room remote from the vessel 11. Under these circumstances equipment costs may be lowered since the compressor motor and related electrical devices need not be of the explosion-proof variety.

The refrigeration controls 25 include thermo-expansion valves as well as the refrigerant surge control tank 55 which are interconnected so as to provide fresh low-pressure liquid refrigerant upon demand. Thus, in accordance with the invention, should a relatively large charge of fluid be delivered to the carbonator vessel 11, the liquid charge is delivered by the nozzles 13 to the distributing trough 15, and a relatively large charge of relatively warm fluid is conducted over the refrigerant plates 17. Under these circumstances, relatively rapid refrigerating action occurs, and additional quantities of low-pressure liquid refrigerant can be quickly delivered to the plates to maintain a relatively uniform temperature within the carbonator vessel 11. In this way, the pressure and temperature experienced by the liquid are kept relatively constant, and the carbon-dioxide-adsorping qualties of the liquid are consequently kept relatively uniform.

The cooled and saturated liquid falling from the refrigerant plates 17 is collected in a sump area 70 in the bottom 19 of the vessel 11. In further accordance with the invention, an upper ultrasonic level control switch 71 is connected to the product feed pump 33 so as to halt the further delivery of liquid to the vessel 11 should the level of fluid in the tank sump 70 rise to an unacceptably high level. When the fluid level in this sump 70 falls to a proper lower level, a second ultrasonic level control switch 72 operates to restart the product feed pump 33 by appropriate interconnection (not shown). Should the level of fluid fall to an unacceptably low level within the sump 70, a third ultrasonic level control switch 73 is connected to an alarm such as an audible alarm signal (not shown). This alarm indicates to the apparatus operators that the liquid level has fallen below the pre-selected minimum level.

Excess carbon dioxide and air driven from the liquid does not collect in the vessel 11, but is exhausted through a gas purge control 78 connected to the vessel 11 through a purge line 79.

In still further accordance with the invention, carbon-dioxide-saturated liquid reaching the vessel outlet 20 can be delivered to the filler unit by the outlet pump 21 or, conversely, can be rerouted to relatively upstream portions of the apparatus to quickly accommodate a reduced filler demand for fluid. To this end, a first branch line 80 is connected, through a Tee 81 and a shut-off valve 82, between the vessel outlet 20 and the primary inlet line 14. Thus, when operational demands placed upon the filler so require, fluid can be routed from the vessel outlet 20 back through the entire carbonating and deaerating system 10 by the inlet line 14. Conversely, fluid can be returned directly to the raw fluid source by backward flow along a branch line 84 when the shut-off valve 82 is closed.

Fluid which is delivered to the filler pump 21 is pressurized to, for example, 200 PSIG as indicated upon a pressure gauge 87 and can be delivered by a second branch outlet line 88 and a Tee transfer line 89 directly to the filler. However, should the delivery of fluid by the pump 21 exceed the demand caused by the filler, the fluid is recirculated by a second branch line 91 through a back pressure regulator 92 for recirculation and return to the carbonator vessel 11. If desired, fluid can be delivered through a recirculator branch line 93 through the vessel top 12. In this way, the fluid is re-cooled and recharged with carbon dioxide, since the fluid again passes over the cooler plates 51 and past the carbon dioxide vessel inlet line 18. If desired, however, a transfer valve 94 in a second branch line 95 can be opened, and the fluid returned directly to the tanks sump 70 found in and adjacent to the tank bottom 19.

In carrying out the invention, fluid which has been supplied to the filler through the line 89 can be returned to the apparatus for futher recirculation so as to still more easily accommodate varying amounts of filler operational demand. To this end, a filler fluid return line 100 directs fluid from the filler to the vessel sump 70. By appropriately actuating the valve 94 or another transfer valve 101, fluid can be directed from the filler return line 100 through the recirculating line 93 to either the top 12 of the vessel for reprocessing 11, or to the sump 70 for quiescent storage. In this way, fluid not required by the filler can be recirculated without shutting down or halting the activity of either the liquid carbonator apparatus or the filler itself. Relatively large quantities of saturated liquid are thus available to satisfy relatively rapid changes in fluid demand.

The invention is claimed as follows:

1. An aerosol carbonator for charging a liquid with a carbon dioxide propellant, comprising, in combination, a saturator vessel, liquid inlet means in the vessel for dispensing liquid within the vessel, at least one cooling member within the vessel for cooling the dispensed liquid, gas inlet means for injecting carbon dioxide gas into the vessel for absorptive contact with the liquid, vessel outlet means, transfer line means connected to the outlet for transferring liquid from the outlet to a remote source of variable fluid demand, and recirculating means connected between the saturator vessel outlet means and the saturator vessel itself for returning to the saturator vessel fluid amounts in excess of those fluid amounts required to be fed into the transfer means to satisfy the source of variable fluid demand.

2. An aerosol carbonator according to claim 1 including a liquid inlet line connected to the liquid inlet means, and liquid flow control means connected to the liquid inlet line for regulating the flow of liquid through the line and inlet to the vessel.

3. An aerosol carbonator according to claim 2 including preliminary gas injection means connected to the liquid inlet line for preliminarily injecting carbon dioxide gas into the the liquid inlet line, whereby to permit a relatively low internal operating pressure in the saturator vessel.

4. An aerosol carbonator according to claim 1 including purge means for exhausting carbon dioxide and other gases from the saturator vessel.

5. An aerosol carbonator according to claim 1 wherein said vessel is vertically elongated and is at least partly defined by a vessel top, an intermediate portion and a vessel bottom, wherein said inlet means includes nozzle means disposed in the vessel top, said cooling means is disposed in the vessel intermediate portion, and said vessel outlet means is disposed in the vessel bottom, and wherein said recirculating means includes a first branch for returning liquid to the vessel top for further cooling and adsorbing action, and a second branch for returning liquid to the vessel bottom without undergoing further cooling and adsorbing action.

6. An aerosol carbonator according to claim 5 including a return line connected between the source of variable fluid demand and said recirculating means for returning fluid to the vessel from the source of variable fluid demand.

7. An aerosol carbonator according to claim 1 including first liquid level control means in said saturator vessel and connected to means in said inlet line for halting liquid delivery to the vessel when a first liquid level is exceeded in the vessel.

8. An aerosol carbonator according to claim 7 including second liquid level control means in the saturator vessel and connected to said means in said inlet line for restarting liquid delivery to the vessel when the level of liquid in said vessel drops below a predetermined second vessel liquid level.

9. An aerosol carbonator according to claim 7 including third liquid level control means in the saturator vessel, and alarm means connected to the third level control means for providing an alarm should the level of liquid in the vessel fall below a predetermined third vessel liquid level.

10. An aerosol carbonator for charging a liquid with carbon dioxide propellant, comprising, in combination, a saturator vessel, liquid inlet means in the vessel for dispensing liquid within the vessel, gas inlet means for injecting carbon dioxide gas into the vessel for adsorbtive contact with the liquid, vessel outlet means for discharging the liquid from the vessel, recirculating means connected between the saturator vessel outlet means and the saturator vessel itself for returning to the saturator vessel fluid amounts in excess of those fluid amounts required to be fed into the transfer means to satisfy the source of variable fluid demand and at least one refrigerated evaporator member within the vessel for cooling the liquid, the carbonator further including means for delivering a liquid refrigerant to the evaporator member, means for drawing gaseous refrigerant from the evaporator member, and control means for controlling the amount of refrigerant delivered to and drawn from the evaporator member for controlling the temperature of the evaporator member and consequently controlling the temperature and pressure experienced by the liquid in the saturator vessel.

11. An aerosol carbonator according to claim 10 including a plurality of evaporator plate members disposed within the vessel for cooling the liquid.

12. An aerosol carbonator according to claim 10 including a trough means disposed in the vessel between the inlet means and the evaporator member for distributing the liquid evenly over the evaporator member to encourage even, maximum liquid cooling.

13. An aerosol carbonator for charging a liquid with a carbon dioxide propellant, comprising in combination, a saturator vessel, liquid inlet means in the vessel for dispensing liquid within the vessel, an inlet line connected between the inlet means and a remote fluid source for leading liquid from the source to the inlet means, at least one cooling member within the vessel for cooling the dispensed liquid, gas inlet means for injecting carbon dioxide gas into the vessel for adsorptive contact with the liquid, vessel outlet means for drawing liquid from the vessel, and recirculating line means including first branch outlet means connected between the vessel outlet means and the inlet line, inlet line valve means for permitting fluid in the recirculating line means to flow alternatively forwardly along the inlet line for recirculation through the liquid inlet means back to the saturator vessel, and rearwardly back through the inlet line means to the remote fluid source, second branch outlet means connected between the vessel outlet means, the vessel, and a remote variable filler source of demand, and pressure regulator valve means in the second branch means for permitting a predetermined amount of the liquid in the second branch outlet means to flow to the remote filler source of demand, and for causing any amount of liquid in excess of a predetermined amount to flow back to the vessel.

14. An aerosol carbonator according to claim 13 wherein said vessel includes a vessel sump, and wherein said aerosol carbonator includes first return line means functionally connected between the second branch outlet and the vessel sump for returning liquid directly to the vessel sump.

15. An aerosol carbonator according to claim 14 wherein said first return line is connected between the vessel sump and the second branch outlet means at a point downstream of said pressure regulator valve means.

16. An aerosol carbonator according to claim 13 wherein said vessel includes a vessel top located above said cooling member and wherein said aerosol carbonator includes second return line means functionally connected between the second branch outlet and the vessel top for returning liquid to the vessel top for further cooling and gas absorption.

17. An aerosol carbonator according to claim 16 wherein said first return line is connected between the vessel top and the second branch outlet means at a point downstream of said pressure regulator valve means.

18. An aerosol carbonator according to claim 13 including filler return line means connected between the remote filler source of demand and the vessel for returning excess fluid from the filler demand source to the vessel.

19. An aerosol carbonator according to claim 18 wherein said vessel includes a vessel sump, and includes a first interconnector line means connected between the filler return line and said vessel sump for returning excess fluid from the filler demand source directly to the vessel sump.

20. An aerosol carbonator according to claim 18 including a second interconnector line providing a fluid path between said filler return line and a vessel top for returning fluid from the remote filler source demand and the vessel top so as to cause said returned fluid to undergo further cooling and gas absorption activity.

* * * * *

UNITED STATES PATENT AND TRADEMARK OFFICE

CERTIFICATE OF CORRECTION

PATENT NO. : 4,133,853
DATED : January 9, 1979
INVENTOR(S) : William C. Ore and Sigmund P. Skoli It is certified that error appears in the above-identified patent and that said Letters Patent are hereby corrected as shown below:

Col. 1, line 30, change "meet" to --met--;

Col. 2, line 25, "adsorptive" should be --absorptive--;

Col. 5, line 16, "adsorbing" should be --absorbing--;

Col. 5, line 18, "adsorbing" should be -- absorbing --.

Col. 5, line 45, "adsorb" should be --absorb--;

Col. 6, line 11, "adsorptive" should be --absorptive--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*